US009565952B1

(12) United States Patent
Luberto et al.

(10) Patent No.: US 9,565,952 B1
(45) Date of Patent: Feb. 14, 2017

(54) MODULAR DISPLAY AND DISPENSING APPARATUS WITH PLURAL DISPENSING TIERS AND METHOD

(71) Applicant: Henschel-Steinau, Inc., Allendale, NJ (US)

(72) Inventors: Michael D. Luberto, River Vale, NJ (US); Andrew B. Sholl, Cranbury, NJ (US)

(73) Assignee: Henschel-Steinau, Inc., Allendale, NJ (US)

( * ) Notice: Subject to any disclaimer, the term of this patent is extended or adjusted under 35 U.S.C. 154(b) by 9 days.

(21) Appl. No.: 14/704,481

(22) Filed: May 5, 2015

(51) Int. Cl.

| | |
|---|---|
| ***A47F 1/04*** | (2006.01) |
| ***A47F 7/00*** | (2006.01) |
| ***A47F 3/14*** | (2006.01) |
| ***A47B 43/00*** | (2006.01) |
| ***A47B 47/00*** | (2006.01) |
| ***A47B 57/00*** | (2006.01) |
| ***A47F 1/12*** | (2006.01) |
| ***A47B 87/02*** | (2006.01) |
| ***A47F 5/00*** | (2006.01) |
| ***A47B 57/58*** | (2006.01) |
| ***A47B 73/00*** | (2006.01) |

(52) U.S. Cl.
CPC ..... *A47F 1/125* (2013.01); *A47B 57/585* (2013.01); *A47B 73/00* (2013.01); *A47B 87/0223* (2013.01); *A47B 87/0269* (2013.01); *A47F 1/04* (2013.01); *A47F 1/126* (2013.01); *A47F 5/005* (2013.01); *A47F 5/0068* (2013.01)

(58) Field of Classification Search
CPC ..... A47F 3/14; A47F 1/126; A47F 1/125; A47F 7/28; A47F 7/281; A47F 7/283;A47F 1/04; A47F 5/0068; A47F 3/02; A47F 5/005; A47B 87/0261; A47B 87/0223; A47B 87/02; A47B 87/0207; A47B 87/0269; A47B 87/0246; A47B 73/00; A47B 73/006; A47B 57/585; B65D 21/048; B65D 21/0209; B65D 21/02; B65D 21/00; B42F 7/12; B42F 7/10
USPC ..... 211/126.2, 126.12, 188, 194, 74, 59.2, 211/59.3, 184
See application file for complete search history.

(56) References Cited

U.S. PATENT DOCUMENTS 2,934,212 A * 4/1960 Jacobson ..... A47F 1/121 211/59.3
3,970,199 A * 7/1976 Marschak ..... A47F 3/14 211/126.12

(Continued)

*Primary Examiner* — Jennifer E Novosad
(74) *Attorney, Agent, or Firm* — Arthur Jacob

(57) ABSTRACT

An apparatus and method display and dispense merchandise at plural dispensing tiers at a point-of-purchase adjacent a display shelf located at a given level and extending along lateral directions. The merchandise is in the form of packages arranged serially along each of at least lower and upper paths of travel spaced apart attitudinally and extending longitudinally toward corresponding lower and upper forward dispensing locations spaced apart attitudinally and placed at the point-of-purchase. Lower dividers are placed for juxtaposition with the lower serially arranged packages, and upper dividers are coupled with the lower dividers for juxtaposition with the upper serially arranged packages such that the lower and upper forward dispensing locations are placed spaced apart attitudinally to establish the plural dispensing tiers at the point-of-purchase. A pusher-track assembly is secured between lower dividers and between upper dividers for the selective dispensing of packages at the point-of-purchase.

22 Claims, 6 Drawing Sheets

(56) References Cited

U.S. PATENT DOCUMENTS

| | | | | | |
|---|---|---|---|---|---|
| 4,685,574 | A * | 8/1987 | Young | A47F 1/12 | 211/184 |
| 4,690,287 | A * | 9/1987 | Fershko | A47F 1/12 | 211/128.1 |
| 4,901,869 | A * | 2/1990 | Hawkinson | A47F 1/126 | 211/184 |
| 5,069,349 | A * | 12/1991 | Wear | A47F 1/126 | 211/194 |
| D330,121 | S * | 10/1992 | Wear | D19/92 | |
| 5,366,099 | A * | 11/1994 | Schmid | A47F 1/126 | 211/175 |
| 5,665,304 | A * | 9/1997 | Heinen | A47F 1/126 | 108/110 |
| 5,806,690 | A * | 9/1998 | Johnson | A47F 1/126 | 211/175 |
| 7,028,852 | B2 * | 4/2006 | Johnson | A47F 1/126 | 108/60 |
| 7,424,957 | B1 | 9/2008 | Luberto | | |
| 7,854,333 | B2 * | 12/2010 | Kottke | A47F 1/12 | 211/59.2 |
| 8,317,038 | B2 | 11/2012 | Luberto et al. | | |
| 8,978,903 | B2 * | 3/2015 | Hardy | A47F 1/126 | 211/126.12 |
| 2005/0127014 | A1 * | 6/2005 | Richter | A47F 1/126 | 211/59.2 |
| 2005/0199564 | A1 * | 9/2005 | Johnson | A47F 1/126 | 211/59.3 |
| 2005/0199565 | A1 * | 9/2005 | Richter | A47F 3/14 | 211/59.3 |

* cited by examiner

MODULAR DISPLAY AND DISPENSING APPARATUS WITH PLURAL DISPENSING TIERS AND METHOD

The present invention relates generally to point-of-purchase display and dispensing of merchandise and pertains, more specifically, to apparatus and method for enabling the display and ready dispensing of serially arranged merchandise packages at plural dispensing tiers at a point-of-purchase dispensing location.

An ever-increasing variety of packaged merchandise offered for sale at points-of-purchase locations along store shelves has led to a requirement for better organization of such merchandise. Among the more prevalent display and dispensing apparatus currently in use on store shelves are those employing pusher-track assemblies to advance serially arranged merchandise packages along a path of travel to a dispensing location placed at the point-of-purchase. Accordingly, in many retail sales environments, pusher-track display and dispensing devices are placed upon shelves at point-of-purchase locations.

Because linear shelf space at such locations usually is at a premium, the placement of pusher-track display and dispensing devices, under current common practice, is restricted to selected, assigned segments of the length of a display shelf, thereby taking advantage of only the limited linear space available along an assigned segment of shelf length. It would be advantageous to be able to utilize as much of the shelf space as possible, of that space made available at any length of shelf space assigned to a particular product to be offered at a point-of-purchase location. Most present display and dispensing devices which utilize a pusher-track assembly system are not constructed so as to take full advantage of vertical space available above a display shelf while still providing the versatility of modular construction to accommodate different products offered in merchandise packages having different spacial requirements, resulting in different width, height and shelf depth needed to accommodate particular merchandise packages.

The present invention provides an improvement in display and dispensing apparatus and method which enables effective use of pusher-track advancement of merchandise packages while increasing capacity along an assigned length of shelf by effectively utilizing shelf space and, more particularly, the space available vertically above the assigned length of display shelf at a point-of-purchase location through providing plural, tiered dispensing paths feeding into corresponding plural dispensing locations. As such, the present invention attains several objects and advantages, some of which are summarized as follows: Provides modular display and dispensing apparatus for attaining enhanced utilization of space available at assigned linear lengths of display shelf space in a retail sales environment, employing pusher-track feed systems; enables efficient and effective display and dispensing of merchandise articles, utilizing pusher-track feed at point-of-purchase locations where linear shelf space is limited; establishes an aesthetically attractive and efficient use of assigned shelf space, with increased capacity and added convenience in utilizing a modular arrangement of pusher-track assemblies to feed merchandise articles at such shelf locations; facilitates the organization of merchandise for display and dispensing at a point-of-purchase located along store shelves; provides simplified plural-tiered pusher-track apparatus constructed economically of less complex component parts; allows ease of set-up and use for accommodating a wide variety of merchandise displayed and dispensed along plural tiers at a point-of-purchase; enables pusher-track feed of merchandise articles along plural tiered paths of travel toward corresponding plural dispensing locations for more versatile dispensing of merchandise articles having various spacial requirements; makes more efficient use of space available along display shelf locations, with pusher-track feed display and dispensing of merchandise articles offered for sale at such locations; increases the capacity available for pusher-track feed in display and dispensing apparatus placed upon an existing display shelf at a point-of-purchase location, without requiring an increase in the length of shelf space occupied by the display and dispensing apparatus; provides the versatility of modular construction in a plural-tiered pusher-track display and dispensing apparatus; minimizes the number and complexity of component parts in a modular display and dispensing apparatus which provides plural dispensing tiers for better space utilization; provides a modular pusher-track feed display and dispensing apparatus of increased capacity at a given display shelf location for reliable operation over an extended service life.

The above objects and advantages, as well as further objects and advantages, are attained by the present invention, which may be described briefly as a modular apparatus for displaying and dispensing merchandise at plural dispensing tiers at a point-of-purchase adjacent a display shelf located at a given level and extending along lateral directions, the merchandise being in the form of packages arranged serially along each of lower and upper paths of travel spaced apart altitudinally and extending longitudinally toward corresponding lower and upper forward dispensing locations spaced apart altitudinally and placed at the point-of-purchase, the apparatus comprising: lower dividers for extending along respective longitudinal directions, spaced apart in a lateral direction for straddling corresponding lower paths of travel, in juxtaposition with the packages arranged serially along the corresponding lower paths of travel, each lower divider including a lower edge for juxtaposition with the given level, and an upper edge, the upper edge of at least selected lower dividers being spaced altitudinally from a corresponding lower edge for placing the upper edge of each selected divider at an upper level spaced altitudinally above the given level when the lower edge of the corresponding selected divider is juxtaposed with the given level; lower basal members, each one of the lower basal members having a first coupling element corresponding to the lower edge of one of the lower dividers for receiving the lower edge of the one of the lower dividers to couple each one of the lower dividers to a corresponding one of the lower basal members; a lower basal member-securing arrangement for securing each lower basal member at a selected lateral location along the lateral direction; lower pusher-track assemblies for extending along respective longitudinal directions adjacent each lower path of travel, in juxtaposition with the packages arranged serially along a respective lower path of travel; a lower pusher track-securing arrangement for securing each lower pusher-track assembly at the given level, at a selected lateral location along the lateral direction, adjacent each lower path of travel; upper dividers for extending along the longitudinal direction, spaced apart in the lateral direction for straddling the upper path of travel, in juxtaposition with the upper packages arranged serially along the upper path of travel, each upper divider including a lower edge for being juxtaposed with the upper level; upper basal members, each one of the upper basal members having a second coupling element corresponding to the lower edge of one of the upper dividers for receiving the lower edge of the one of the upper dividers to couple each one of the upper dividers to a corresponding one of the upper basal members; an upper basal member-securing arrangement for securing each upper basal member at the upper level, at a selected second lateral location along the lateral direction; upper pusher-track assemblies for extending along longitudinal directions adjacent each upper path of travel, in juxtaposition with packages arranged serially along each upper path of travel; an upper pusher track-securing arrangement for securing each upper pusher-track assembly at the upper level, at a respective selected upper lateral location along the lateral direction, adjacent a respective upper path of travel; and a connection arrangement for affixation to the upper edge of each selected lower divider for securing each upper basal member-securing arrangement and each upper pusher track-securing arrangement to the upper edges of the selected lower dividers; such that upon securing lower basal members and lower pusher-track assemblies in place along the lateral direction, at the given level, with lower dividers straddling corresponding lower paths of travel and lower pusher-track assemblies intermediate lower dividers, and upon attaching upper basal member-securing arrangements and upper pusher track-securing arrangements in place along the lateral direction, at the upper level, with upper dividers straddling corresponding upper paths of travel, and upper pusher-track assemblies intermediate upper dividers, the lower and upper forward dispensing locations will be placed respectively at the lower and upper levels, spaced apart altitudinally to establish the plural dispensing tiers at the point-of-purchase.

In addition, the present invention provides a method for displaying and dispensing merchandise at plural dispensing tiers at a point-of-purchase adjacent a display shelf located at a given level extending along lateral directions, the merchandise being in the form of packages arranged serially along each of lower and upper paths of travel spaced apart altitudinally and extending longitudinally toward corresponding lower and upper forward dispensing locations spaced apart altitudinally and placed at the point-of-purchase, the method comprising: extending lower dividers along respective longitudinal directions, spaced apart in a lateral direction to straddle corresponding lower paths of travel, for juxtaposition with the packages arranged serially along the corresponding lower paths of travel; juxtaposing a lower edge of each lower divider with the given level, to place an upper edge of at least selected lower dividers at an upper level spaced altitudinally above the given level of each selected lower divider; coupling each lower divider with a corresponding lower basal member; securing each lower basal member at a selected lateral location along the lateral direction; extending a lower pusher-track assembly along a respective longitudinal direction adjacent each lower path of travel, for juxtaposition with the packages arranged serially along each lower path of travel; securing each lower pusher-track assembly at the given level, at a respective selected lateral location along the lateral direction, adjacent a respective corresponding lower path of travel; extending upper dividers along respective longitudinal directions, spaced apart in the lateral direction to straddle each corresponding upper path of travel, for juxtaposition with the packages arranged serially along the corresponding upper paths of travel, while juxtaposing a lower edge of each upper divider with the upper level; coupling each upper divider to a corresponding upper basal member; securing each upper basal member at the upper level, at a respective selected lateral location along the lateral direction; extending an upper pusher-track assembly along a longitudinal direction adjacent each upper path of travel, for juxtaposition with packages arranged serially along each upper path of travel; securing each upper pusher-track assembly at the upper level, at a selected upper lateral location along the lateral direction, adjacent a corresponding upper path of travel; and affixing a connection arrangement to the upper edge of each selected lower divider and attaching the upper basal member-securing arrangements and the upper pusher track-securing arrangements to the upper edge of each selected lower divider; such that upon securing the lower basal members and the lower pusher-track assembly in place along the lateral direction, at the given level, with the lower dividers straddling corresponding lower paths of travel and the lower pusher-track assemblies intermediate corresponding lower dividers, and upon attaching the upper basal member-securing arrangements and the upper pusher track-securing arrangements in place along the lateral direction, at the upper level, with the upper dividers straddling respective upper paths of travel, and the upper track assemblies intermediate corresponding upper dividers, the lower and upper forward dispensing locations will be placed respectively at the lower and upper levels, spaced apart altitudinally to establish the plural dispensing tiers at the point-of-purchase.

The invention will be understood more fully, while still further objects and advantages will become apparent, in the following detailed description of preferred embodiments of the invention illustrated in the accompanying drawing, in which.

Figure 1:
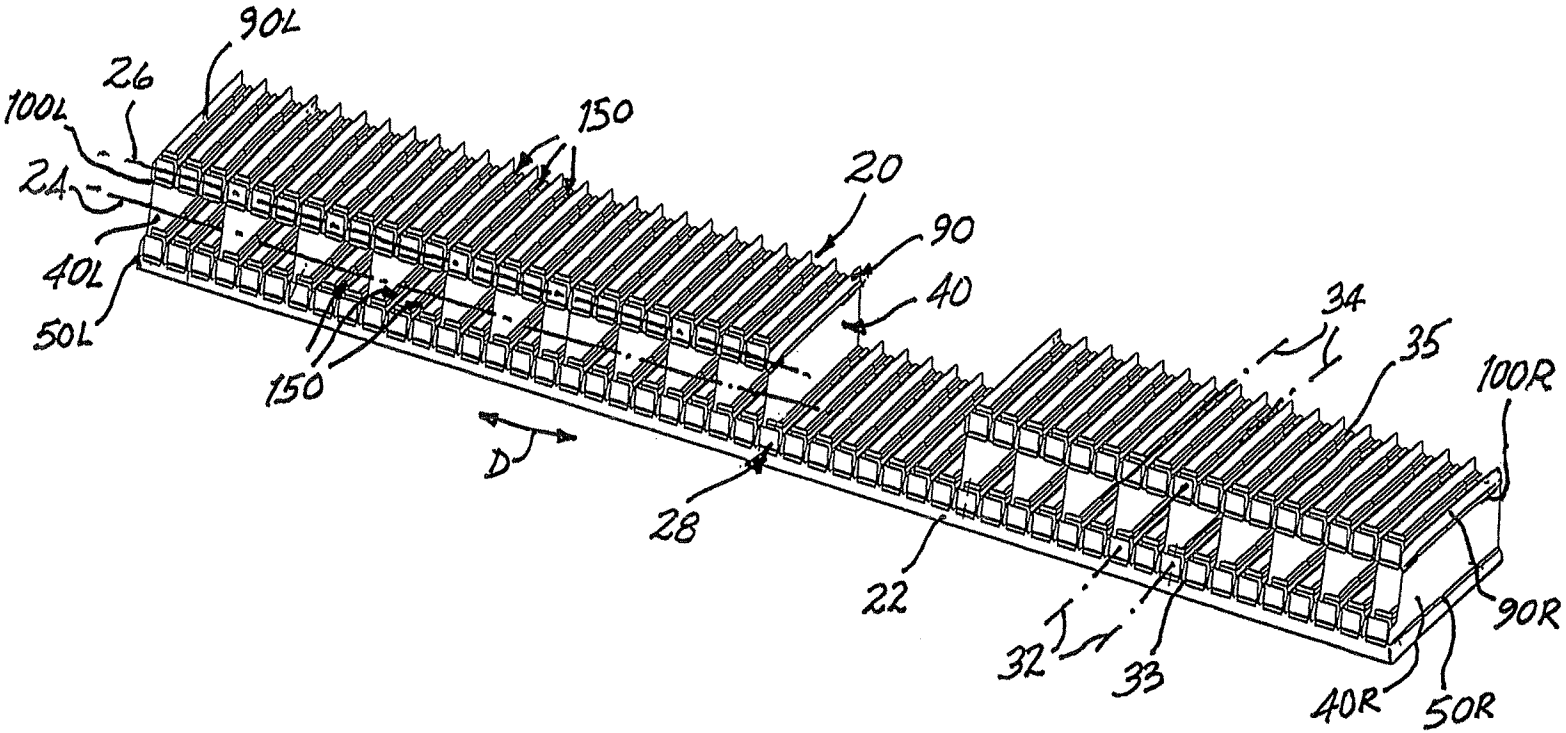
FIG. 1 is a top, front and right side pictorial view of a modular display and dispensing apparatus constructed in accordance with the present invention.
Figure 2:
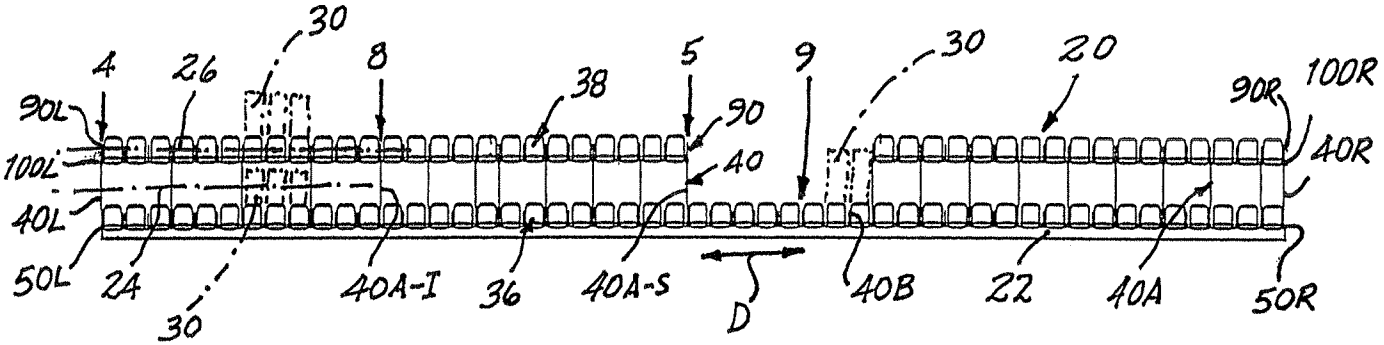
FIG. 2 is a somewhat diagrammatic front elevational view of the apparatus.
Figure 3:
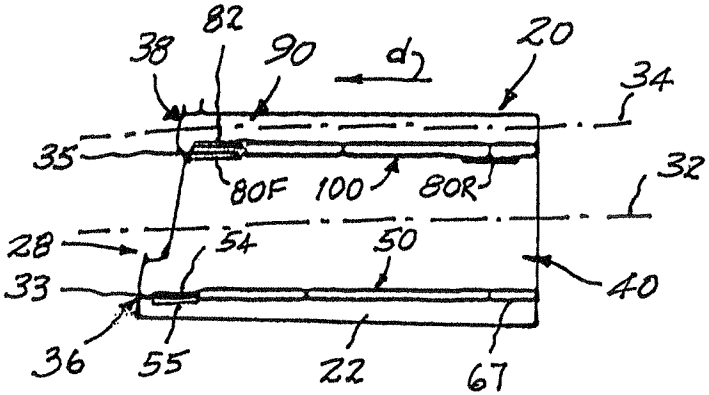
FIG. 3 is an enlarged, somewhat diagrammatic right side elevational view of the apparatus.

Referring now to the drawing, and especially to FIGS. 1 through 3 thereof, a modular apparatus constructed in accordance with the present invention is shown at 20 and is seen installed upon a display shelf 22 for displaying and dispensing merchandise at plural tiers 24 and 26 adjacent a point-of-purchase 28. Merchandise to be displayed and dispensed is in the form of multiple individual packages 30, some of which packages 30 are illustrated in phantom in FIG. 2, the packages 30 being arranged serially along corresponding paths of travel, illustrated as lower paths of travel 32, placed at a lower level 33, and upper paths of travel 34, placed at an upper level 35, as seen in FIG. 3 (also see FIG. 10). The paths of travel 32 and 34 are spaced apart attitudinally and extending in longitudinal directions d toward corresponding lower and upper forward dispensing locations 36 and 38 spaced apart attitudinally and placed at the point-of-purchase 28. Display shelf 22 is placed at a given lower level, corresponding to lower level 33, and extends along lateral directions D, while plural tiers 24 and 26 are spaced apart attitudinally, thereby making effective use of the attitudinal space available above the given level of shelf 22 in presenting packages 30 at plural, attitudinally spaced apart lower and upper dispensing locations 36 and 38. In the preferred construction, dispensing locations 36 and 38 are staggered longitudinally, thereby facilitating access by a purchaser to lower dispensing location 36.

Figure 4:
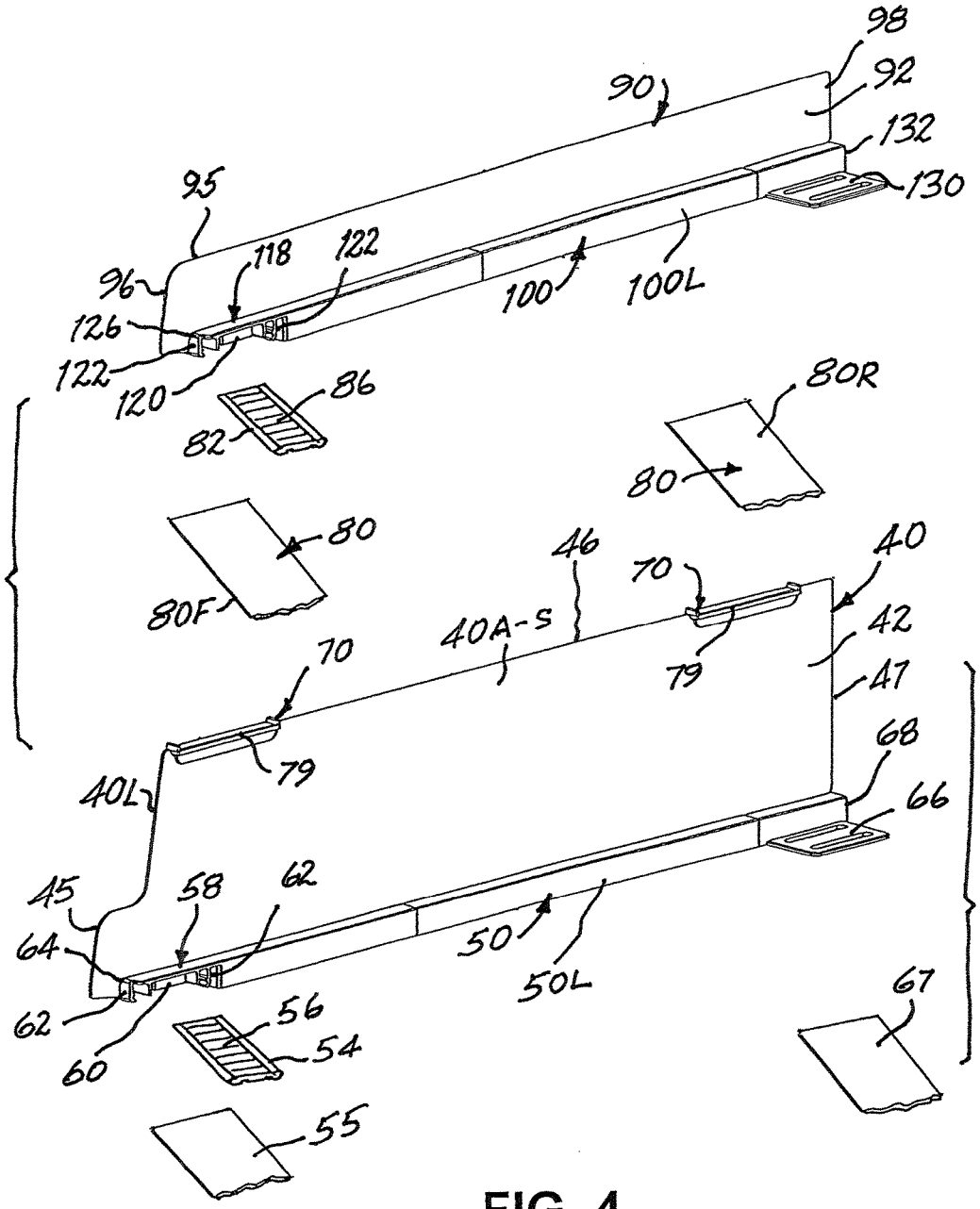
FIG. 4 is a fragmentary, exploded pictorial view showing certain selected component parts located at the left side of the apparatus, as indicated at arrow 4 in FIG. 2.
Figure 5:
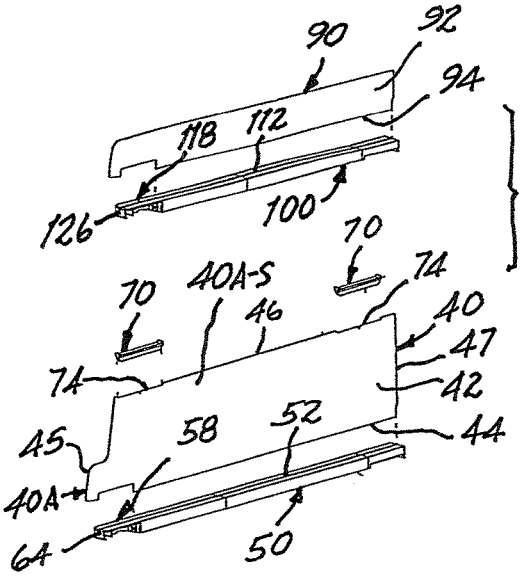
FIG. 5 is a fragmentary, exploded pictorial view showing further selected component parts at a location indicated at arrow 5 in FIG. 2, intermediate the sides of the apparatus.

Apparatus 20 is illustrated with a multiplicity of dividers, shown in the form of lower dividers 40 and upper dividers 90 extending longitudinally and spaced apart laterally, respectively, along the lower and upper levels 33 and 35, to straddle corresponding paths of travel 32 and 34, in juxtaposition with the packages 30 arranged serially along each path of travel 32 and 34. Turning now to FIGS. 4 through 7, lower dividers 40 each are constructed in the form of a substantially flat, planar plate 42 having a lower edge 44 for juxtaposition with the given lower level of shelf 22, a front end 45 and a back end 47. At least some of the lower dividers 40, illustrated as dividers 40A, include an upper edge 46 spaced attitudinally from the lower edge 44 a sufficient distance to be placed adjacent the upper level 35 when the lower edge 44 is at the lower level 33. Each plate 42 is coupled with a lower basal member 50 through a coupling element in the form of a channel 52 extending longitudinally along the lower basal member 50 and being complementary to lower edge 44 so as to receive lower edge 44 to join plate 42 to basal member 50, as seen in FIG. 4. A lower basal member-securing arrangement includes a retainer plate 54 affixed to a retention strip 55 which, in turn, is affixed to the shelf 22 so as to extend laterally along the shelf 22, adjacent the first forward dispensing location 36, the retainer plate 54 having a multiplicity of laterally spaced apart longitudinally extending retainers, shown in the form of grooves 56. In a manner described more fully in U.S. Pat. Nos. 7,424,957 and 8,317,038, the disclosures of which are incorporated herein by reference thereto, each basal member 50 includes an engagement construct 58 comprised of a pair of tongues 60 depending from the basal member 50 between fingers 62 to capture and secure each basal member 50, adjacent the front end 64 of the basal member 50, at a selected lateral location along the retainer plate 54 and, consequently, along the shelf22. In addition, each side basal member 50, identified in FIG. 1 as left side basal member 50L and right side basal member 50R, includes an integral, laterally inwardly extending tab 66, as shown in FIG. 4 in connection with basal member 50L, for affixation to a second retention strip 67 spaced longitudinally rearwardly from forward retention strip 55, and to shelf 22, so as to anchor and stabilize the back end 68 of basal members 50L and 50R against movement relative to shelf 22, as well as to secure retention strip 67 against movement.

With each lower divider 40 in place along shelf 22, thereby establishing lower tier 24, upper tier 26 is established as follows: A connection arrangement includes a pair of connectors in the form of clips 70, each clip 70 having a slot 72 complementary to the upper edge 46 of at least selected ones of the lower dividers 40A, as illustrated by divider 40A-S, the dividers 40A-S preferably being provided with recesses 74 for locating and securing clips 70 in connection with corresponding dividers 40A-S. Each clip 70 includes a support surface 76 attitudinally opposite slot 72, and shoulders 78 spaced apart longitudinally at boundaries of the support surface 76. Recesses 74 assure that once a clip 70 is coupled with a divider 40A-S, support surface 76 is placed at the same altitudinal level as the remainder of upper edge 46. Retention strips 80 then are extended laterally across all of the dividers 40, from divider 40L to divider 40R, accurately positioned upon the upper edges 46 of dividers 40A, as well as upon support surfaces 76, between shoulders 78, and secured to each clip 70, as by an adhesive layer or a double-stick tape 79 (see FIG. 4) between a retention strip 80 and each corresponding support surface 76 placed on a divider 40A-S. Recesses 74 assure that support surfaces 76 are located at the same altitudinal level as the upper edges 46 of all of the dividers 40A, thereby maintaining structural integrity throughout the lateral extent of apparatus 20. A second, upper retainer plate 82 is affixed to the forward retention strip 80F, upper retainer plate 82 having essentially the same configuration as the lower retainer plate 54, including a multiplicity of laterally spaced apart longitudinally extending retainers, in the form of grooves 86.

With the retention strips 80 in place as described above, upper dividers 90 are secured in place, spaced laterally from one another along retention strips 80. In a construction similar to that described above in connection with lower dividers 40, each upper divider 90 includes a substantially flat, planar plate 92 having a lower edge 94 for juxtaposition with the upper level 35, an upper edge 95, a front end 96 and a back end 98. Each plate 92 is coupled with an upper basal member 100 through a coupling element in the form of a channel 112 extending longitudinally along the upper basal member 100 and being complementary to lower edge 94 so as to receive lower edge 94 to join plate 92 to basal member 100. An upper basal member-securing arrangement includes upper retainer plate 82 affixed to the forward retention strip 80F so as to extend laterally along the retention strip 80F, adjacent the second forward dispensing location 38. Again, in a manner described more fully in U.S. Pat. Nos. 7,424,957 and 8,317,038, the disclosures of which are incorporated herein by reference thereto, each basal member 100 includes an engagement construct 118 comprised of a pair of tongues 120 depending from the basal member 100 between fingers 122 to capture and secure each basal member 100, adjacent the front end 126 of the basal member 100, at a selected lateral location along the retainer plate 82 and, consequently, along the shelf 22. In addition, each side basal member 100, identified in FIGS. 1 and 2 as left side basal member 100L and right side basal member 1008, shown coupled respectively with let side upper divider 90L and right side upper divider 90R, includes an integral, laterally inwardly extending tab 130, as shown in FIG. 4 in connection with basal member 100L, for affixation to rearward retention strip 80R, spaced longitudinally rearward of forward retention strip 80F, so as to anchor and stabilize the back end 132 of basal member 100L against lateral movements relative to rearward retention strip 80R and, consequently, to shelf 22.

Figure 8:
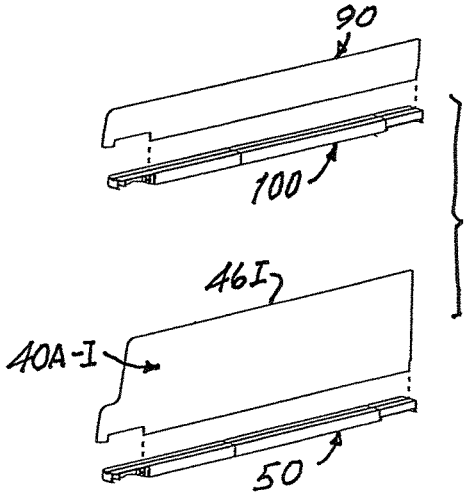
FIG. 8 is a fragmentary, exploded pictorial view showing still further selected component parts at another location, indicated at arrow 8 in FIG. 2, intermediate the sides of the apparatus.
Figure 6:
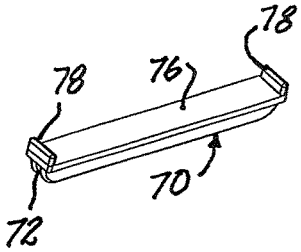
FIG. 6 is an enlarged pictorial view of one of the component parts illustrated in FIGS. 4 and 5.
Figure 9:
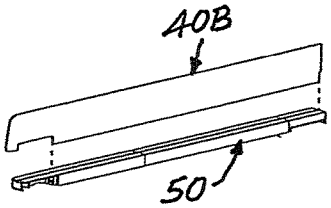
FIG. 9 is a fragmentary, exploded pictorial view showing yet further selected component parts at another location, indicated at arrow 9 in FIG. 2, intermediate the sides of the apparatus.
Figure 7:
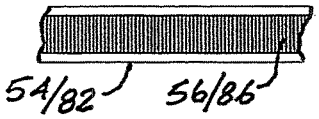
FIG. 7 is an enlarged fragmentary top plan view of another of the component parts illustrated in FIG. 4.

With reference to FIG. 8, at certain intermediate locations, such as that indicated by arrow 8 in FIG. 2, it is not essential to include clips 70 upon a lower divider. Accordingly, an intermediate lower divider 40A-I is shown without recesses 74, allowing the retention strips 80 (depicted in FIG. 4) to rest directly upon the upper edge 46-I of divider 40A-I, at the same altitudinal level provided by the support surfaces 76 of clips 70 along those dividers 40A-S which do carry clips 70. The remaining components, namely, upper divider 90, and basal members 50 and 100, are unchanged. At other intermediate locations, such as that indicated by arrow 9 in FIG. 2, an attitudinally shorter lower divider may be employed, as illustrated, for example, in FIG. 9, by the placement of shorter lower divider 40B, assembled with a basal member 50, at a selected lateral location.

Dividers 40 (including dividers 40A, 40A-S, 40A-I and 40B), and 90 are provided in predetermined longitudinal lengths between corresponding front and back ends 47, 96 and 47, 98 so as to be available for installation on shelves of different depths. Thus, plates 42 and 92, being substantially flat and planar, are economically manufactured by die-cutting from flat sheets, preferable of a suitably rigid synthetic polymeric material, to create plates 42 and 92 having dimensions that will meet the needs of the variety of shelving sizes and configurations encountered in the field. Further to that end, basal members 50 and 100 are constructed in predetermined longitudinal lengths between corresponding respective front and back ends 64, 126 and 68, 132, preferably by injection molding of a synthetic polymeric material, enabling the assembly of selected plates 42 and 92 and corresponding selected basal members 50 and 100 to establish the overall desired length of a divider 40 or 90.

Figure 10:
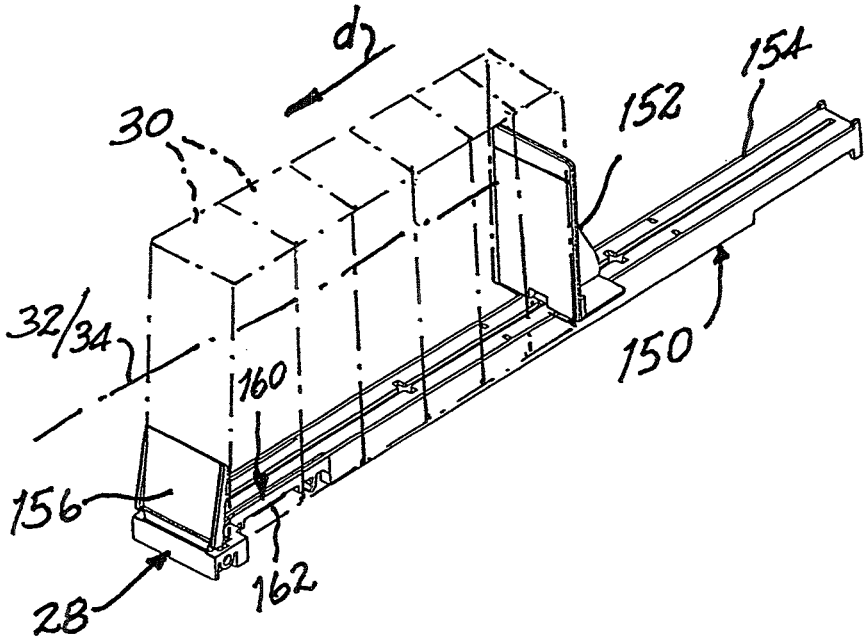
FIG. 10 is a top, front and right side pictorial view of an assembly of component parts of the apparatus.

Referring now to FIG. 10, a pusher-track assembly 150 includes a pusher 152 mounted upon a track 154 for sliding movement along longitudinal directions d, with the pusher 152 biased forward, toward a forward stop 156, in a manner fully described in connection with the pusher-track assembly disclosed in the aforesaid U.S. Pat. Nos. 7,424,957 and 8,317,038. A pusher-track securing arrangement 160 includes an engagement construct comprised of a pair of tongues 162 depending from the track 154 between fingers 164 to capture and secure a pusher-track assembly 150 on a retainer plate 54 or 82, adjacent the front end 166 of the pusher-track assembly 150, at a selected lateral location along either one of the retainer plates 54 and 82, placed between corresponding adjacent dividers 40 or 90 to establish the lower and upper paths of travel 32 and 34 along which merchandise packages 30 are biased forward into lower and upper forward dispensing locations 36 and 38 spaced apart attitudinally and placed at the point-of-purchase 28.

Figure 11:
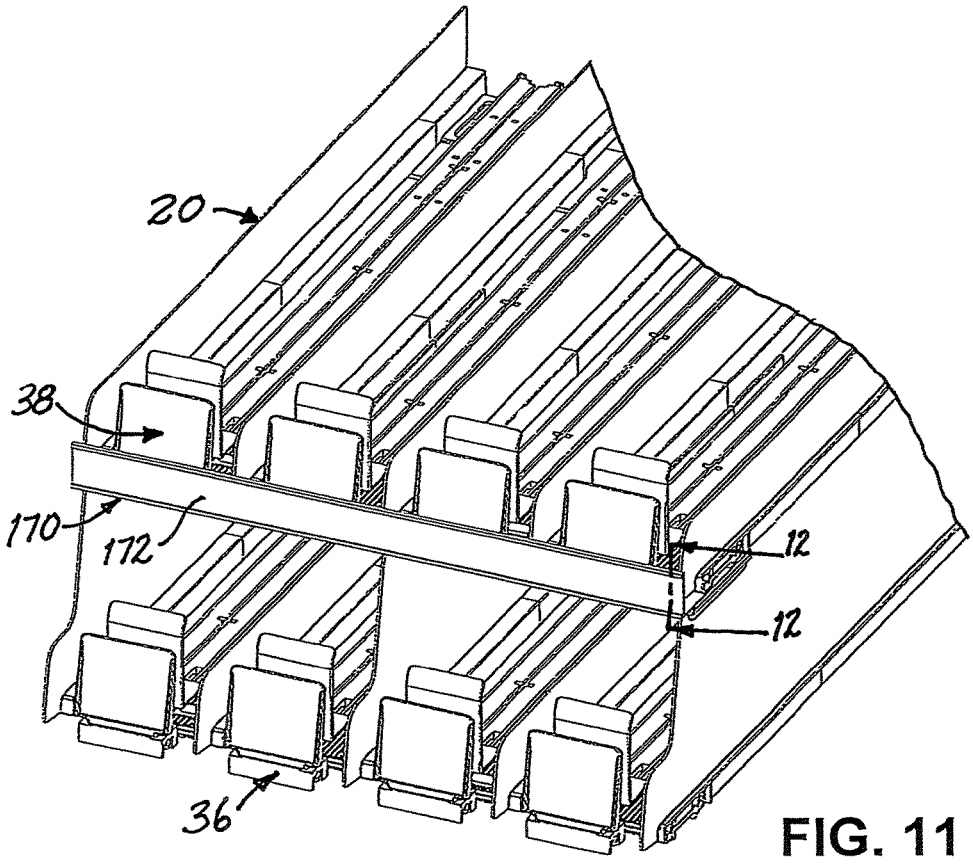
FIG. 11 is an enlarged pictorial view of a section of the apparatus shown in FIG. 1, modified to show an alternate construction.
Figure 12:
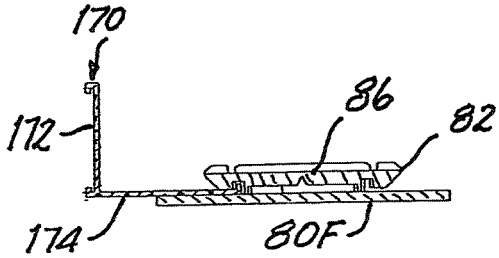
FIG. 12 is a further enlarged cross-sectional view taken along line 12-12 of FIG. 11, with certain structural elements deleted for clarity.

Turning now to FIGS. 11 and 12, a section of apparatus 20 illustrates a modification in which a price channel member 170 has been added along the upper level 35. Price channel member 170 includes a generally vertically-oriented price channel 172 extending laterally along the upper dispensing location 38, and an integral leg 174 extending longitudinally to be captured between forward retention strip 80F and upper retainer plate 82.

It will be seen that the present invention attains all of the objects and advantages summarized above, namely: Provides modular display and dispensing apparatus for attaining enhanced utilization of space available at assigned linear lengths of display shelf space in a retail sales environment, employing pusher-track feed systems; enables efficient and effective display and dispensing of merchandise articles, utilizing pusher-track feed at point-of-purchase locations where linear shelf space is limited; establishes an aesthetically attractive and efficient use of assigned shelf space, with increased capacity and added convenience in utilizing a modular arrangement of pusher-track assemblies to feed merchandise articles at such shelf locations; facilitates the organization of merchandise for display and dispensing at a point-of-purchase located along store shelves; provides simplified plural-tiered pusher-track apparatus constructed economically of less complex component parts; allows ease of set-up and use for accommodating a wide variety of merchandise displayed and dispensed along plural tiers at a point-of-purchase; enables pusher-track feed of merchandise articles along plural tiered paths of travel toward corresponding plural dispensing locations for more versatile dispensing of merchandise articles having various spacial requirements; makes more efficient use of space available along display shelf locations, with pusher-track feed display and dispensing of merchandise articles offered for sale at such locations; increases the capacity available for pusher-track feed in display and dispensing apparatus placed upon an existing display shelf at a point-of-purchase location, without requiring an increase in the length of shelf space occupied by the display and dispensing apparatus; provides the versatility of modular construction in a plural-tiered pusher-track display and dispensing apparatus; minimizes the number and complexity of component parts in a modular display and dispensing apparatus which provides plural dispensing tiers for better space utilization; provides a modular pusher-track feed display and dispensing apparatus of increased capacity at a given display shelf location for reliable operation over an extended service life.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. A modular apparatus for displaying and dispensing merchandise packages at plural dispensing tiers at a point-of-purchase adjacent a display shelf located at a given level and extending along lateral directions, the merchandise packages being adapted to be arranged serially along each of lower and upper paths of travel spaced apart attitudinally and extending longitudinally toward corresponding lower and upper forward dispensing locations spaced apart altitudinally and placed at the point-of-purchase, the apparatus comprising:

lower dividers adapted to extend along respective longitudinal directions, spaced apart in a lateral direction in juxtaposition with corresponding lower paths of travel, each lower divider including a lower edge adapted for juxtaposition with the given level, and an upper edge spaced attitudinally from a corresponding lower edge for placing the upper edge of a selected lower divider at an upper level spaced altitudinally above the given level when the lower edge of a corresponding selected lower divider is juxtaposed with the given level;

lower basal members, each having a first coupling element corresponding to the lower edge of a corresponding lower divider for receiving the lower edge of the corresponding lower divider to couple each lower divider to a corresponding lower basal member;

a lower basal member-securing arrangement adapted to secure each lower basal member at a selected lateral location along the lateral direction;

lower pusher-track assemblies adapted to extend along respective longitudinal directions adjacent each lower path of travel, in juxtaposition with a respective lower path of travel;

a lower pusher track-securing arrangement adapted to secure each lower pusher-track assembly at the given level, at a selected lateral location along the lateral direction, adjacent each lower path of travel;

upper dividers adapted to extend along the longitudinal direction, spaced apart in the lateral direction, in juxtaposition with the upper path of travel, each upper divider including a lower edge adapted for being juxtaposed with the upper level;

upper basal members, each having a second coupling element corresponding to the lower edge of a corresponding upper divider for receiving the lower edge of the corresponding upper divider to couple each upper divider to a corresponding upper basal member;

an upper basal member-securing arrangement adapted to secure each upper basal member at the upper level, at a selected second lateral location along the lateral direction;

upper pusher-track assemblies adapted to extend along respective longitudinal directions adjacent each upper path of travel, in juxtaposition with a respective upper path of travel;

an upper pusher track-securing arrangement adapted to secure each upper pusher-track assembly at the upper level, at a respective selected upper lateral location along the lateral direction, adjacent a respective upper path of travel; and a connection arrangement adapted for affixation to the upper edge of each selected lower divider to secure each upper basal member-securing arrangement and each upper pusher track-securing arrangement to corresponding upper edges of the selected lower dividers;

such that with lower basal members and lower pusher-track assemblies secured in place along the lateral direction, at the given level, with lower dividers juxtaposed with corresponding lower paths of travel and lower pusher-track assemblies in place intermediate lower dividers, and with upper basal member-securing arrangements and upper pusher track-securing arrangements attached in place along the lateral direction, at the upper level, with upper dividers juxtaposed with corresponding upper paths of travel, and upper pusher-track assemblies in place intermediate upper dividers, the lower and upper forward dispensing locations are placed respectively at the lower and upper levels, spaced apart altitudinally to establish the plural dispensing tiers at the point-of-purchase.

2. The apparatus of claim 1 wherein each lower divider is constructed of a substantially flat, planar plate extending between upper and lower edges.

3. The apparatus of claim 2 wherein each first coupling element comprises a first channel extending along a longitudinal direction and configured for receiving the lower edge of a corresponding lower divider in secure engagement.

4. The apparatus of claim 2 wherein each lower divider is constructed of a die-cut substantially rigid synthetic polymeric material.

5. The apparatus of claim 2 wherein each upper divider is constructed of a substantially flat, planar plate extending between a lower edge and an attitudinally opposite upper edge.

6. The apparatus of claim 5 wherein each' second coupling element comprises a second channel extending along a longitudinal direction and configured for receiving the lower edge of a corresponding upper divider in secure engagement.

7. The apparatus of claim 5 wherein each lower divider and each upper divider are constructed of a die-cut substantially rigid synthetic polymeric material.

8. The apparatus of claim 1 wherein the connection arrangement includes at least one retention strip for extending in a lateral direction from one to another of the lower dividers, and a connector for affixing the retention strip to the selected lower dividers, adjacent the upper edge of each selected lower divider.

9. The apparatus of claim 8 wherein the connector comprises a clip having a longitudinally-extending slot for receiving a corresponding portion of the upper edge of a selected lower divider, and an attitudinally opposite support surface for receiving the retention strip.

10. The apparatus of claim 8 wherein the connection arrangement includes a retainer plate juxtaposed with the retention strip and having a plurality of retainers spaced apart laterally along the retainer plate, and each second basal member-securing arrangement and each second pusher-securing arrangement includes a respective engagement construct for engagement with a corresponding selected retainer to secure a respective basal member-securing arrangement and pusher-track assembly to the retainer plate at a corresponding selected lateral location along the retainer plate.

11. The apparatus of claim 10 wherein the connector comprises a clip having a longitudinally-extending slot for receiving a corresponding portion of the upper edge of a selected lower divider, and an attitudinally opposite support surface for receiving the retention strip.

12. The apparatus of claim 1 wherein the connection arrangement includes a forward retention strip adjacent the upper forward dispensing location, a longitudinally opposite rearward retention strip spaced longitudinally from the forward retention strip, and a connector for affixing each retention strip to the selected lower dividers, adjacent the upper edge of each selected lower divider.

13. The apparatus of claim 12 wherein the connector arrangement includes a retainer plate juxtaposed with each forward retention strip, each retainer plate having a plurality of retainers spaced apart laterally along a respective retainer plate, each second basal member-securing arrangement and each second pusher-securing arrangement including a corresponding engagement construct for engagement with a corresponding selected retainer to secure a respective basal member-securing arrangement and a respective pusher-track assembly to a corresponding retainer plate at a selected lateral location along the corresponding retainer plate.

14. The apparatus of claim 13 wherein the connector comprises a clip having a longitudinally-extending slot for receiving a corresponding portion of the upper edge of a selected lower divider, and an altitudinally opposite support surface for receiving a corresponding retention strip.

15. A method for displaying and dispensing merchandise packages at plural dispensing tiers at a point-of-purchase adjacent a display shelf located at a given level extending along lateral directions, the merchandise packages being adapted to be arranged serially along each of lower and upper paths of travel spaced apart altitudinally and extending longitudinally toward corresponding lower and upper forward dispensing locations spaced apart altitudinally and placed at the point-of-purchase, the method comprising:

extending lower dividers along respective longitudinal directions, spaced apart in a lateral direction, in juxtaposition with corresponding lower paths of travel;

juxtaposing a lower edge of each lower divider with the given level, to place an upper edge of selected lower dividers at an upper level spaced altitudinally above the given level of each selected lower divider;

coupling each lower divider with a corresponding lower basal member;

securing each lower basal member at a selected lateral location along the lateral direction;

extending a lower pusher-track assembly along a respective longitudinal direction adjacent each lower path of travel;

securing each lower pusher-track assembly at the given level, at a respective selected lateral location along the lateral direction, adjacent a respective corresponding lower path of travel;

extending upper dividers along respective longitudinal directions, spaced apart in the lateral direction in juxtaposition with corresponding upper paths of travel, while juxtaposing a lower edge of each upper divider with the upper level;

coupling each upper divider to a corresponding upper basal member;

securing each upper basal member at the upper level, at a respective selected lateral location along the lateral direction;

extending an upper pusher-track assembly along a longitudinal direction adjacent each upper path of travel;

securing each upper pusher-track assembly at the upper level, at a selected upper lateral location along the lateral direction, adjacent a corresponding upper path of travel; and affixing a connection arrangement to the upper edge of each selected lower divider and attaching the upper basal member-securing arrangements and the upper pusher track-securing arrangements to the upper edge of each selected lower divider;

such that with the lower basal members and the lower pusher-track assembly secured in place along the lateral direction, at the given level, with the lower dividers juxtaposed with corresponding lower paths of travel and the lower pusher-track assemblies intermediate corresponding lower dividers, and with the upper basal member-securing arrangements and the upper pusher track-securing arrangements attached in place along the lateral direction, at the upper level, with the upper dividers juxtaposed with respective upper paths of travel, and the upper track assemblies intermediate corresponding upper dividers, the lower and upper forward dispensing locations are placed respectively at the lower and upper levels, spaced apart altitudinally to establish the plural dispensing tiers at the point-of-purchase.

16. The method of claim 15 including constructing each lower divider of a substantially flat, planar plate extending between corresponding upper and lower edges.

17. The method of claim 16 including die-cutting each lower divider from a substantially rigid synthetic polymeric material.

18. The method of claim 16 including constructing each upper dividers of a substantially flat, planar plate extending between a corresponding lower edge and an altitudinally opposite upper edge.

19. The method of claim 18 including die-cutting each lower divider and each upper divider from a substantially rigid synthetic polymeric material.

20. The method of claim 15 including extending a retention strip in a lateral direction from one to the other of the lower dividers, and securing the retention strip to selected ones of the lower dividers, adjacent the upper edge of each selected lower divider.

21. The method of claim 20 including affixing a clip to a corresponding portion of the upper edge of each selected lower divider, and affixing the retention strip to each clip.

22. The method of claim 20 including providing the retention strip with a retainer plate having a plurality of retainers spaced apart laterally along the retainer plate, and engaging each of the upper basal member-securing arrangements and each of the upper pusher track-securing arrangements with a corresponding selected retainer to secure respective upper basal member-securing arrangements and respective upper pusher-track assemblies to the retainer plate at corresponding selected lateral locations along the retainer plate.

* * * * *